US005199231A

United States Patent [19]

Dever

[11] Patent Number: 5,199,231

[45] Date of Patent: Apr. 6, 1993

[54] VILLAGES OF MOLDED HOUSES

[76] Inventor: DeLora B. Dever, 601 NE. S. Shore Rd., Portland, Oreg. 97211

[21] Appl. No.: 820,759

[22] Filed: Jan. 15, 1992

[51] Int. Cl.[5] ..... E04H 1/00

[52] U.S. Cl. ..... 52/79.1; 52/79.4; 52/176; 52/187; 52/236.2

[58] Field of Search ..... 52/79.1, 79.4, 176, 52/236.2, 236.3, 202, 189, 187

[56] References Cited

U.S. PATENT DOCUMENTS 4,434,595 3/1984 de Brabant ..... 52/236.2
4,555,877 12/1985 Libra ..... 52/236.2
4,612,741 9/1986 Jacobson ..... 52/236.2

*Primary Examiner*—David A. Scherbel
*Assistant Examiner*—Wynn E. Wood
*Attorney, Agent, or Firm*—R. Lewis Gable

[57] ABSTRACT

A multipurpose structure is disclosed as comprising a plurality of housing units, and a core support building of eliptical shape. The building has an exterior curved surface disposed forwardly for supporting the residential housing units and an essentially flat, exterior surface disposed rearwardly of the curved support surface. Inside the building, there is a plurality of floors for housing ancillary activities of the residents of the housing units. Access is provided from each of the floors to each of those housing units associated with the floor.

14 Claims, 4 Drawing Sheets

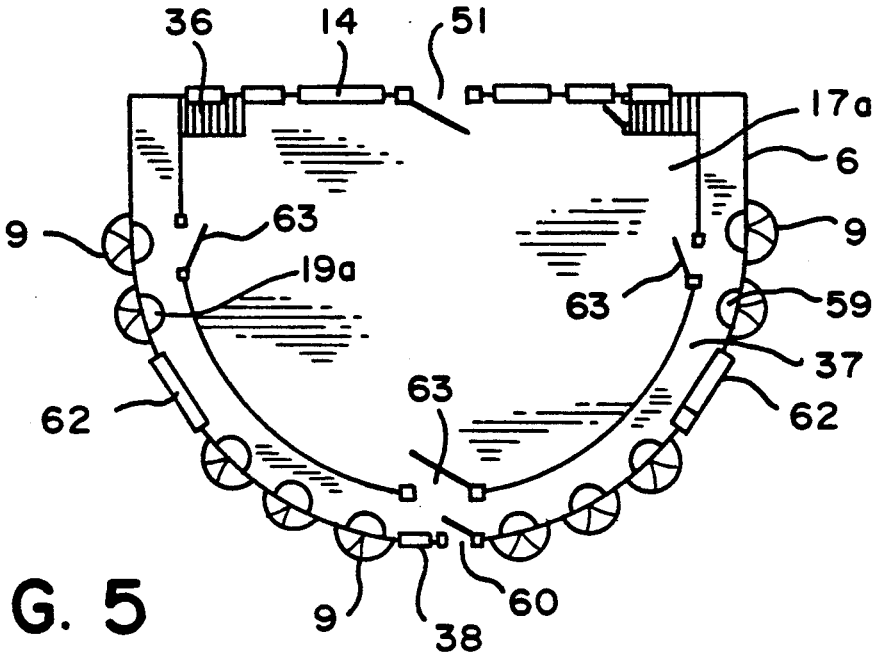
FIG. 5
FIG. 6
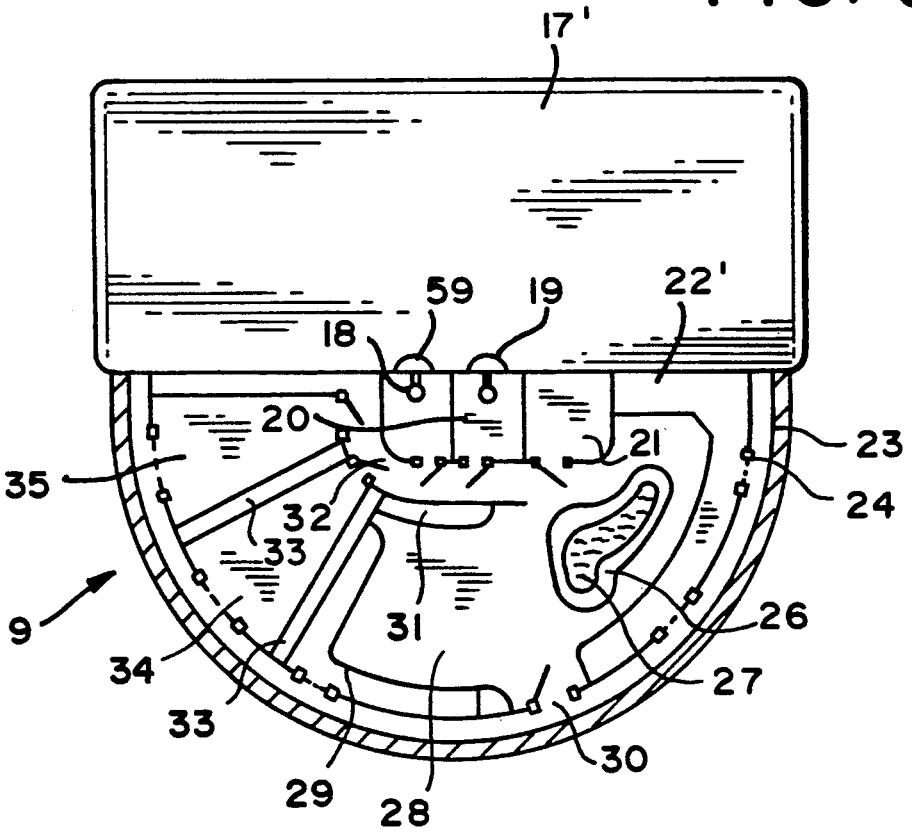

VILLAGES OF MOLDED HOUSES

FIELD OF THE INVENTION

This invention relates to a means to comfortably placing thousands of people into residential housing units arranged together in villages, where the basic housing needs and employment of the residents will be provided. More specifically, this invention relates to anchoring molded housing units on the exterior surface of a core support building. The support building not only supports the housing units, but also includes space for receiving stores, employment sites, hospital units, social, recreational and other facilities to which the residents will have immediate access.

BACKGROUND OF THE INVENTION

Conventional residential arrangements include apartments, condominiums and individual housing units. Such places don't provide immediate accesses to places for buying their needs or for employment. Typically, residents must travel by autos, buses or taxis from their residences to stores or places of employment. Shopping and commercial facilities consume vast tracts of often fertile farm lands and forest lands, thus depriving the residents of access to wild life habitats and destroying the natural environment.

This invention would condense both living space and shopping and employment areas into compact arrangements or villages. My arrangement of residential units provide for better security, increased living space, more wind resistance and immediate access to shopping, working, hospital and entertainment facilities. The quality of life of the residents would be significantly improved. The need for commuting roads is reduced, whereby the natural environment is not only protected but is also made available to the residents of my villages.

SUMMARY OF THE INVENTION

It is an object of this invention to provide a new and improved structure for assembling housing units and spaces for retain and work activities into a compact and efficient structure.

In accordance with this and other objects of the invention, there is disclosed a multipurpose structure comprising a plurality of housing units, and a core support building of eliptical shape. The building has an exterior curved surface disposed forwardly for supporting the residential housing units and an essentially flat, exterior surface disposed rearwardly of the curved support surface. Inside the building, there is a plurality of floors for housing ancillary activities of the residents of the housing units. Access is provided from each of the floors to each of those housing units associated with the floor.

In a further aspect of this invention, a hallway is disposed adjacent to each floor and has a configuration corresponding to that of the curved support surface. Each floor has an area defined by the hallway and the flat exterior surface for receiving the ancillary activities.

In a still further aspect of this invention, there is further included a support slab for mounting the core support building thereon. The slab includes a rear portion adjacent the flat exterior surface and a front portion adjacent the curved surface. The rear portion of said slab is weighted with respect to the front portion to provide thereby a weight balancing the housing units disposed upon the curved support surface.

BRIEF DESCRIPTION OF THE DRAWINGS

FIG. 5 is a floor or plan view of a single floor of the support building;

FIG. 6 is a plan view of a single unit of the village of FIG. 1 and particularly adapted for residential habitation.

PREFERRED EMBODIMENT

Figure 2:
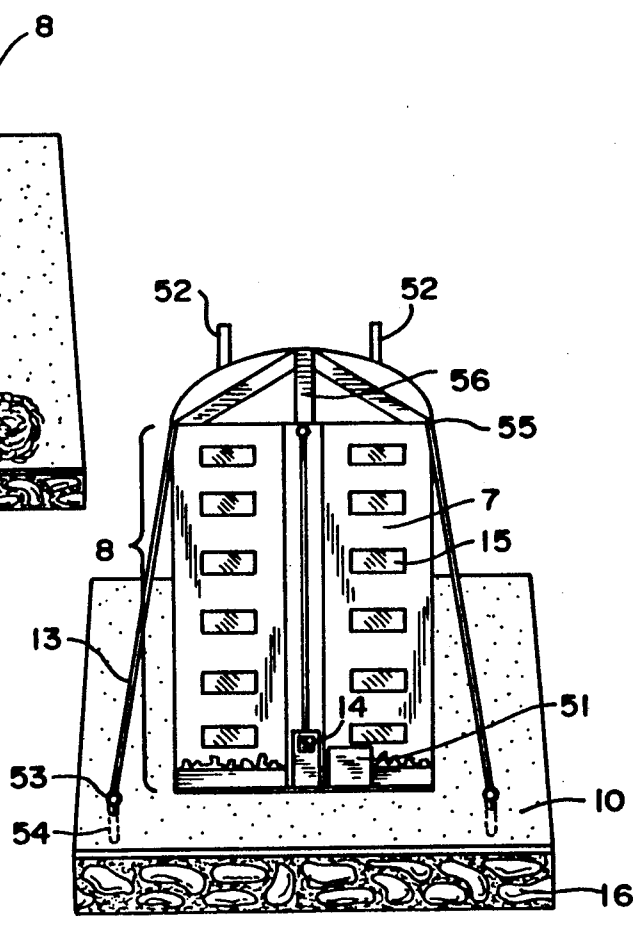
FIG. 2 is a perspective view of the rear side of one of the core support buildings, shown in FIG. 1.
Figure 1:
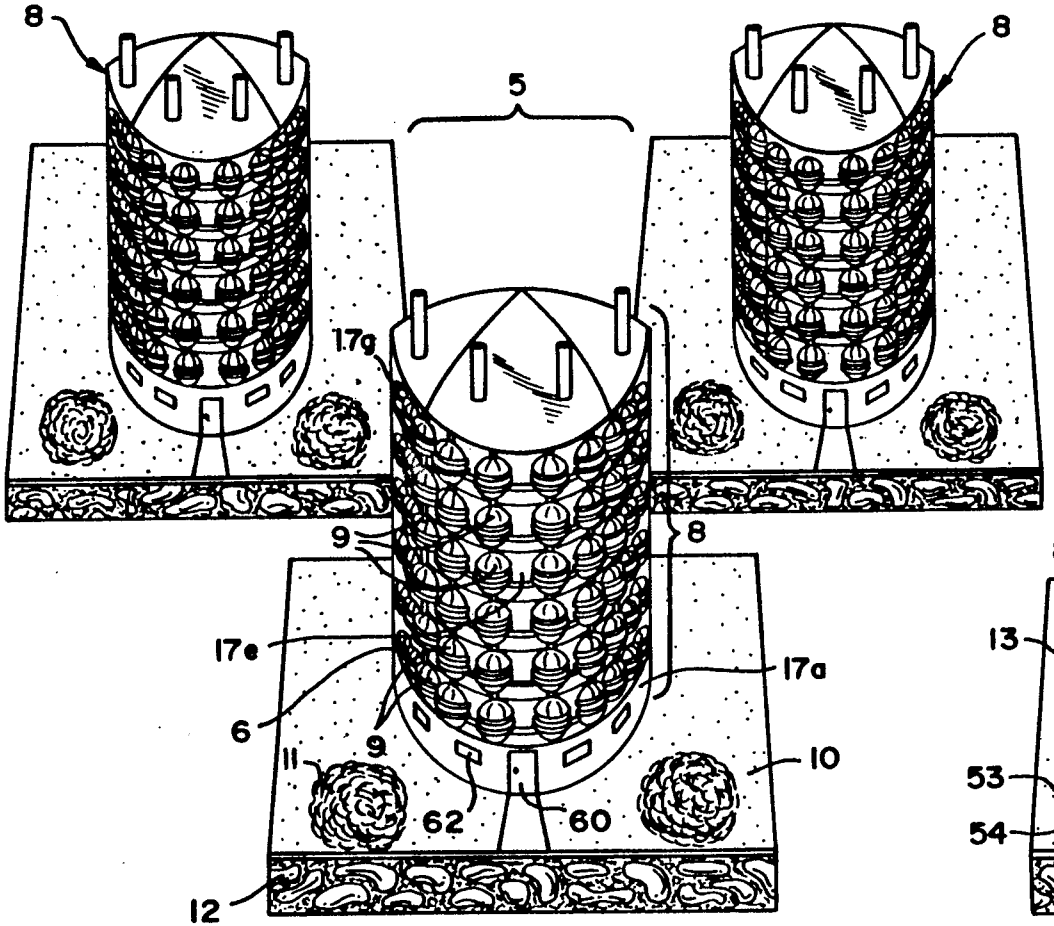
FIG. 1 is a perspective view of three core support buildings arranged in a village and supporting a plurality of housing units in accordance with my invention, showing the front side of the buildings.

Referring now to the drawings and in particular FIG. 1, there is shown an arrangement of a plurality of half-ellipse-shaped housing units 9 commonly supported from a curved support surface 7 provided by each of a plurality of similarly shaped, core support building 8. The core support building 8 is constructed with a plurality of floors 17, each floor 17 having a plurality of the housing units 9 associated therewith, whereby access is provided to each of its units 9. In FIGS. 1 and 2, each of the core support buildings 8 have seven floors 17*a–g*, with floor 17*a* being the ground or main floor and floor 17*g* being the top floor. Windows 15 are disposed in a rear surface 7 of each of the support buildings 8 and are aligned to permit sunlight to enter each floor 17.

Each core support building 8 is securely mounted on a heavy concrete of slab 10. Planters 11 decorate the front of the slab 10 and boulders 12 are embedded in the front of the slab 10. The rear, flat surface of the support building 8 is shown in FIG. 2. Each of a pair of heavy bridge type support cables 13 has one end secured to the top of the rear surface 7 and its other end attached to the concrete slab 10 to balance the weight of the housing units 9 imposed on the front support surface 6 of the building 8. In particular, each of the other ends of the cables 13 is attached securely to an anchor grommet 53, which has a straight, support portion 54 embedded within the concrete slab 10. Boulders 16, which are larger than the boulders 12, are embedded into the back portion of the slab 10 to provide it with increased weight and support for the cables 13 and the support building 8 secured thereto. A pair of cross beams 55 is joined with a center beam 56 to support a dome-shade roof 52. Ventilating pipes 52 extend upward from each of the floors 17 through the roof 52 to ventilate the building 8. A service elevator 14 provides access to all of the floors 17*a–g*. Planters 11 with plants therein extend the width of the building 8.

Referring now to FIG. 5, 17*a* represents a plan view of a single floor 17 of the support building 8. A pathway or hallway 37 encircles each floor 17 and provides direct access to the housing units 9 associated with that floor. The hallway 37 is wide enough so that a vehicle can pick up the used toilet and garbage bags; the bags contain dehydrated materials light in weight and are securely closed so that there is no odor. A toilet bag container 19a is disposed adjacent to each of the housing units 9 to collect the garbage and refuse bags. A pair of safety stairways 36 extend from the top floor 17g to the storage and utility basement, interconnecting each floor 17. A front elevator 38 goes to all floors 17, and is disposed besides a front door 60. The back service elevator 14 also goes to all floors 17 and is disposed besides a back door 51. Shopping and employment facilities may be disposed on the floors 17. For example, a floor 17 could accommodate small shops, a grocery store and most commercial enterprises found in a supermarket. Another floor 17 could be a place for employment commerce. A significant advantage of the arrangement of the floors 17 and housing units 9 within each core support building 8 is that employment and shopping facilities are brought close to and are integrated with the housing units 9 in a compact, efficient structure, namely the core support structure 8.

Figure 4:
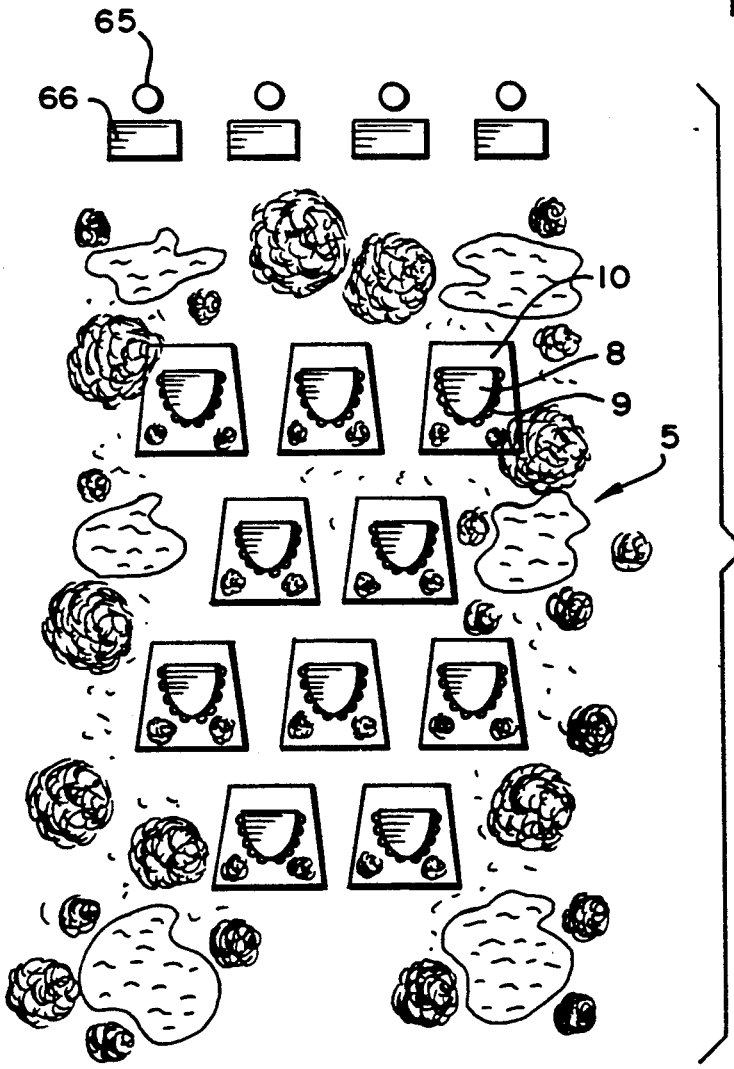
FIG. 4 shows a plan view of a village and its surrounding grounds.

Referring now to FIG. 6, 17' represents a portion of a floor 17, which is attached to one of the single housing units 9. FIG. 6 shows the floor plan of a housing unit 9 to be a half circle. A generally circular hallway 32 provides access to a pair of bedrooms 34 and 35, a front or living room 28, bathrooms 20 and an utility room 21. A waterless toilet 18 and a container 19 keep the bags of trash or refuse. A trash shoot 59 provides a conduit from each of the floors 17 to the main floor 17a, whereby trash and waste may be taken to a composting sewage plant 65, which is shown in FIG. 4. The living room or front room 28 includes cupboard section 22, where the garbage container 19 and its hallway collection receptacle are located. A planter 23 of vegetables, small fruits and flowers encircle its housing unit 9; in the winter it is enclosed with circular plastic windows so that edibles can be raised all year. An outer pathway or hallway 24 encircles the housing unit 9 and can be used for child's play or adult outdoor dinning and sitting. The living or front room 28 contains an outsized mushroom shaped table 26 for dining and family gathering, and includes a kitchen area used as an extra workspace. Underneath the table 26 are built-in shelves allowing for knee room. An extra mushroom-shaped, raised shelf 27 is disposed over the table's center for holding hobby objects and current family use items. The front room 28 blends into a dining area and includes a comfort rocker 30 with an adjustable footrest and an entertainment center 31 in view from the dining area as well as the front room 28. Each of the bedrooms 34 and 35 includes a room length closet 33. The bedrooms 34 and 35 are pie-shaped to conserve space leaving the narrowest part for an entrance from the hallway 32 and the widest part near the windows 58 and its view, where the bed or beds are placed so that they can look out of the windows 58.

Figure 3:
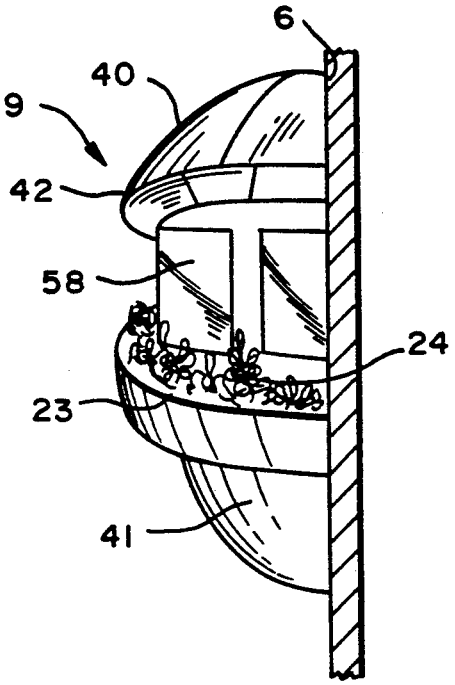
FIG. 3 shows a side view of a single housing unit supported by a support surface of the support building of FIGS. 1 and 2.

Referring now to FIG. 3, a side view of the half-ellipse-shaped housing unit 9 as attached to the core support building 8 is shown. Each housing unit 9 includes a dome 40 providing a ceiling for the bedrooms 34 and 35, and the dining and front room 28, as shown in FIG. 6. The planter 23 for raising vegetables, small fruits and flowers, and the outdoor hallway section 24 are shown extending about the periphery of its housing unit 9. A bottom section 41 is shown that could be used a recreation room or extra bedrooms with its own bathroom and stairway. A loft study (not shown) could be disposed over the front room 28, and part of the bedrooms 34 and 35 beneath the dome 40.

Figure 7:
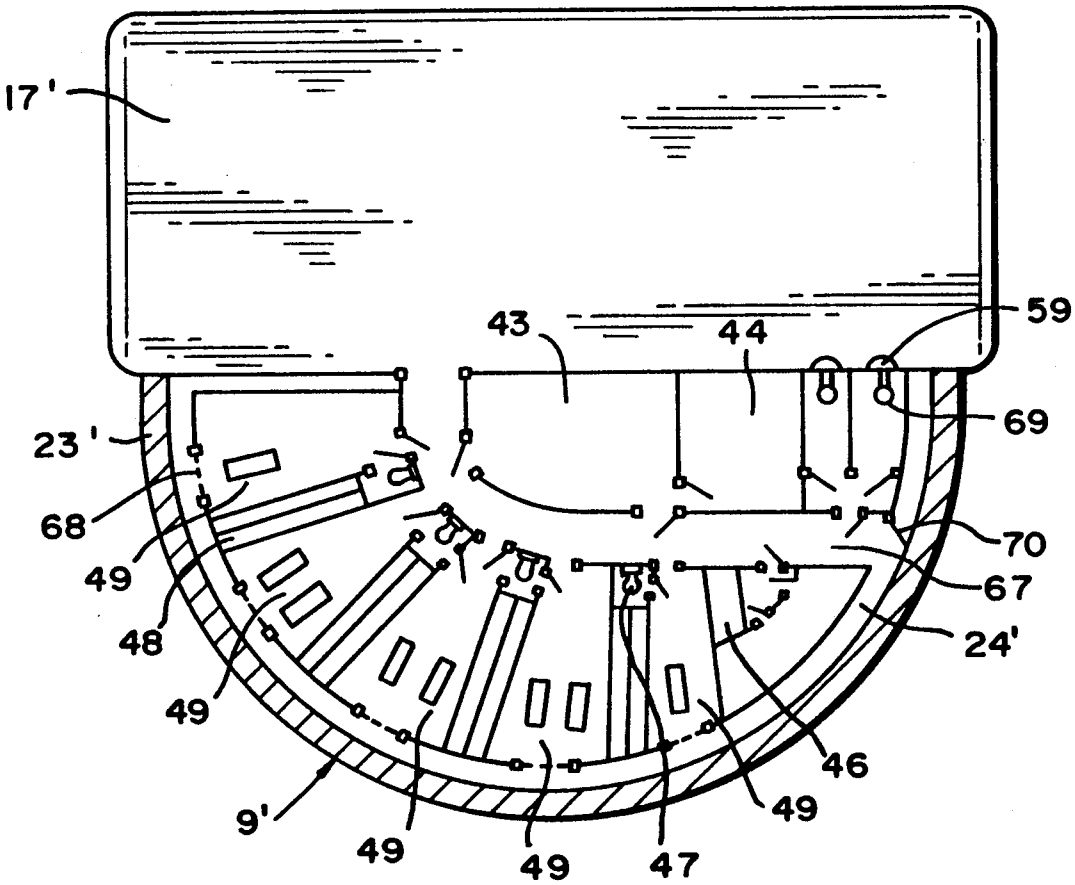
FIG. 7 is a plan view of an alternative unit of the core support building of FIGS. 1 and 2 adapted to serve as a hospital.

Referring now to FIG. 7, one of the housing units 9' may be adapted to be used as a hospital. A hallway 67 provides access from the floor 17 to each of a plurality of patient's rooms 49, a nurse's observation station 43 that is centrally disposed with respect to every patient's room 49, a filing and medical supply room 46, a nurse's bathroom 44 and a patient's bath and shower room 46. Each of the patient's rooms 49 includes a toilet 47, and a general purpose build-in. The patient's rooms 49 are pie-shaped, and some are private with a single bed and others are semi-private with two beds. The hallway 67 is connected with a door 70 that opens to a wheelchair ramp leading to a broad observation outdoor walkway 24' disposed about the exterior of the hospital unit 9'. Flowers and shrubbery growing in the circular planter 23' give cheer to the patient's rooms 49. Part of this floor 17 associated with the hospital unit 9' could also be used for medical purposes. If there are enough buildings 8 in the village 5, operating rooms and diagnostic facilities could also be included in the hospital unit 9'.

As shown in FIG. 4, a plurality of the core support buildings 8 is assembled as the village 5. Each building 8 has its concrete slab 10 and front planters. Ponds, trees and shrubbery are disposed throughout the village 5. A composting sewage plant and a plurality of storage vats 66 are provided adjacent the village 5.

I claim:

1. A multipurpose structure comprising:

a) a plurality of housing units;

b) a core support building or elliptical shape comprising a front curved surface and a rear flat surface whereby said housing units are disposed thereon said front curved surface; and c) a support slab for mounting said core support building thereon whereby said slab includes a rear portion adjacent said rear flat surface and a front surface adjacent said front curved surface, said rear portion comprising means for providing a balancing weight relative to said front portion to balance said plurality of housing units.

2. The multipurpose structure of claim 1 wherein said core support building comprises a plurality of floors for housing ancillary activities for the residents of said housing units whereby at least one of said floors comprises a hallway disposed adjacent and having a configuration corresponding to said front curved surface and an area defined by said hallway and said rear flat surface for receiving said ancillary activities.

3. The multipurpose structure as claimed in claim 2, wherein core support building comprises access means, said access means comprising at least one door associated with each of said plurality of housing units, each of said doors being disposed within said front curved surface to permit passage between its housing unit and said hallway.

4. The multipurpose structure as claimed in claim 2, wherein said plurality of floors includes a main floor and a top floor, and there is further included conveying means for carrying residents of said plurality of housing units from said main floor to any other of said plurality of floors.

5. The multipurpose structure as claimed in claim 4, wherein said conveying means comprises an elevator making stops at each of said plurality of floors and having access to said hallway of each of said floors.

6. The multipurpose structure as claimed in claim 1, wherein said slab comprises concrete.

7. The multipurpose structure as claimed in claim 1, wherein said slab is made of concrete, and said rear portion thereof comprises relatively large boulders to provide said balancing weight.

8. The multipurpose structure as claimed in claim 2, wherein said plurality of floors includes a top floor and there in further included at least one support cable including one end secured to said rear flat surface adjacent said top floor and another end secured to said slab.

9. The multipurpose structure as claimed in claim 1, wherein each of said plurality of housing units comprises a first interior surface of an eliptical configuration attached to and conforming to said eliptical shape of said front curved surface, and a second exterior surface of a hemispherical configuration.

10. The multipurpose structure as claimed in claim 9, wherein each of said plurality of housing units comprises a floor of a height aligned with that of an associated one floor of said plurality of floors of said core support building.

11. The multipurpose structure as claimed in claim 10, wherein there is included a plurality of pie-shaped rooms disposed adjacent said second exterior surface and an interior hallway disposed remotely of said second exterior surface for permitting access to each of said plurality of pie-shaped rooms.

12. The multipurpose structure as claimed in claim 11, wherein said access means comprises a door for each of said plurality of housing units disposed in said curved support surface for providing access between said associated floor and said interior hallway.

13. The multipurpose structure as claimed in claim 11, wherein there is included a second hallway disposed exterior of said housing unit and extending about said second exterior surface.

14. The multipurpose structure as claimed in claim 13, wherein there is included a planter extending along at least a portion of said second exterior hallway for facilitating the growth of vegetation.

* * * * *